US010787921B2

(12) United States Patent
Brigham et al.

(10) Patent No.: US 10,787,921 B2
(45) Date of Patent: Sep. 29, 2020

(54) HIGH PRESSURE TURBINE REAR SIDE PLATE

(71) Applicant: UNITED TECHNOLOGIES CORPORATION, Farmington, CT (US)

(72) Inventors: Derek A Brigham, East Hartford, CT (US); Jeffrey Leon, Glastonbury, CT (US); David Dwyer Whittle, Sandwich, MA (US); Amarnath Ramlogan, Glastonbury, CT (US); Brian J Burke, South Windsor, CT (US); Santiago Orellana, Vernon, CT (US); Tania Bhatia Kashyap, West Hartford, CT (US); Dianbo Li, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 407 days.

(21) Appl. No.: 16/130,126

(22) Filed: Sep. 13, 2018

(65) Prior Publication Data

US 2020/0088052 A1 Mar. 19, 2020

(51) Int. Cl.
*F01D 5/30* (2006.01)
*F01D 11/00* (2006.01)

(52) U.S. Cl.
CPC ..... *F01D 11/001* (2013.01); *F01D 5/3015* (2013.01); *F05D 2240/55* (2013.01); *F05D 2240/80* (2013.01)

(58) Field of Classification Search
CPC .. F01D 5/3015; F01D 11/001; F05D 2240/55; F05D 2240/80
See application file for complete search history.

(56) References Cited

U.S. PATENT DOCUMENTS 4,846,628 A * 7/1989 Antonellis ..... F01D 5/3015 416/220 R
5,622,475 A * 4/1997 Hayner ..... F01D 5/3015 416/219 R
6,106,234 A 8/2000 Gabbitas
(Continued)

FOREIGN PATENT DOCUMENTS

EP 0833039 4/1998
EP 1944471 7/2008
(Continued)

OTHER PUBLICATIONS

European Patent Office, European Search Report dated Feb. 24, 2020 in Application No. 19197204.1.

*Primary Examiner* — Igor Kershteyn
(74) *Attorney, Agent, or Firm* — Snell & Wilmer L.L.P.

(57) ABSTRACT

A cover plate for a rotor assembly is disclosed. In various embodiments, the cover plate includes an annular member having a radially inner portion and a radially outer portion with respect to a longitudinal axis, the radially inner portion including an aft face and an angled forward face, the angled forward face defining a forward face angle with respect to a cylindrical plane that is coaxial with the longitudinal axis, the face angle having a value that is greater than or equal to fifty degrees; a first tab and a second tab disposed proximate the radially inner portion of the annular member; and a slot disposed between the first tab and the second tab.

17 Claims, 5 Drawing Sheets

(56) References Cited

U.S. PATENT DOCUMENTS

| | | | | |
|---|---|---|---|---|
| 6,520,743 | B2 * | 2/2003 | Arilla | F01D 5/3015 416/204 A |
| 7,040,866 | B2 * | 5/2006 | Gagner | F01D 5/3015 416/220 R |
| 7,238,008 | B2 * | 7/2007 | Bobo | F01D 5/3015 416/220 R |
| 7,371,050 | B2 * | 5/2008 | Pasquiet | F01D 5/3015 416/204 A |
| 9,212,562 | B2 * | 12/2015 | Burt | F01D 5/3015 |
| 9,249,676 | B2 * | 2/2016 | Antonellis | F01D 5/3015 |
| 2015/0369061 | A1 * | 12/2015 | Sandoval | F01D 5/3015 60/805 |
| 2016/0017737 | A1 * | 1/2016 | Partyka | F01D 5/3015 416/214 A |
| 2019/0071971 | A1 * | 3/2019 | Leon | F01D 5/02 |

FOREIGN PATENT DOCUMENTS

| | | |
|---|---|---|
| GB | 2244100 | 11/1991 |
| WO | 2014120135 | 8/2014 |
| WO | 2014168862 | 10/2014 |

* cited by examiner

HIGH PRESSURE TURBINE REAR SIDE PLATE

FIELD

The present disclosure relates to gas turbine engines and, more particularly, to side plates used on turbine rotor assemblies of gas turbine engines.

BACKGROUND

Gas turbine engines, such as those used to power modern commercial and military aircraft, include a fan section to propel the aircraft, a compressor section to pressurize a supply of air from the fan section, a combustor section to burn a hydrocarbon fuel in the presence of the pressurized air, and a turbine section to extract energy from the resultant combustion gases in order to power the compressor and fan sections.

Turbine sections within gas turbine engines commonly include one or more rotors, each having a plurality of blades extending radially outward of the rotors relative to a central longitudinal or rotational axis about which each of the rotors rotates. In some gas turbine engines, one or more cover plates are secured to the rotors within the turbine sections. The cover plates may assist in creating cooling volumes for the faces and other portions of the rotors and plenums for cooling air to flow into the root sections and then into the interiors of the blades comprising one or more of the pluralities of blades. The cover plates may also assist in securing the root sections of the blades within the radially outer portions or rims of the rotors.

SUMMARY

A cover plate for a rotor assembly is disclosed. In various embodiments, the cover plate includes an annular member having a radially inner portion and a radially outer portion with respect to a longitudinal axis, the radially inner portion including an aft face and an angled forward face, the angled forward face defining a forward face angle with respect to a cylindrical plane that is coaxial with the longitudinal axis, the face angle having a value that is greater than or equal to fifty degrees; a first tab and a second tab disposed proximate the radially inner portion of the annular member; and a slot disposed between the first tab and the second tab.

In various embodiments, the radially inner portion further includes a first forward face disposed radially inward of the angled forward face. In various embodiments, the radially inner portion further includes a second forward face disposed radially outward of the angled forward face. In various embodiments, the first forward face has a first forward face normal directed substantially parallel to the longitudinal axis. In various embodiments, the second forward face has a second forward face normal directed substantially parallel to the longitudinal axis.

In various embodiments, the cover plate includes a web face extending radially from proximate the radially inner portion to proximate the radially outer portion and the aft face is offset in a forward axial direction from the web face by an offset distance. In various embodiments, the aft face is configured for engagement with an annular arm of a rotor disk. In various embodiments, the aft face includes an aft face normal that is directed substantially parallel to the longitudinal axis.

In various embodiments, the slot includes a slot face that intersects the angled forward face along a forward intersection line. In various embodiments, the forward intersection line includes a sharp transition portion extending from a first slot end to a second slot end. In various embodiments, the slot face intersects the aft face along an aft intersection line and the aft intersection line includes a chamfered portion extending from the first slot end to the second slot end. In various embodiments, the slot face intersects the aft face along an aft intersection line and the aft intersection line includes a radiused portion extending from the first slot end to the second slot end. In various embodiments, the forward face angle is within a range from about fifty degrees to about eighty degrees.

A rotor assembly for a turbine section of a gas turbine engine is disclosed. In various embodiments, the rotor assembly includes a rotor disk configured to rotate about a longitudinal axis; a plurality of blades extending radially outward of the rotor disk from a rim portion of the rotor disk; and a cover plate configured for attachment to the rotor disk. In various embodiments, the cover plate includes an annular member having a radially inner portion and a radially outer portion with respect to the longitudinal axis, the radially inner portion including an aft face and an angled forward face, the angled forward face defining a forward face angle with respect to a cylindrical plane that is coaxial with the longitudinal axis, the face angle having a value that is greater than or equal to fifty degrees; a first tab and a second tab disposed proximate the radially inner portion of the annular member; and a slot disposed between the first tab and the second tab.

In various embodiments, the radially inner portion further includes a first forward face disposed radially inward of the angled forward face and a second forward face disposed radially outward of the angled forward face. In various embodiments, the first forward face has a first forward face normal directed substantially parallel to the longitudinal axis and the second forward face has a second forward face normal directed substantially parallel to the longitudinal axis. In various embodiments, the cover plate further includes a web face extending radially from proximate the radially inner portion to proximate the radially outer portion and the aft face is offset in a forward axial direction from the web face by an offset distance.

In various embodiments, the slot includes a slot face that intersects the angled forward face along a forward intersection line, the forward intersection line including a sharp transition portion extending from a first slot end to a second slot end, and the slot face intersects the aft face along an aft intersection line, the aft intersection line including one of a chamfered portion or a radiused portion extending from the first slot end to the second slot end. In various embodiments, the forward face angle is within a range from about fifty degrees to about eighty degrees.

A high pressure turbine section of a gas turbine engine is disclosed. In various embodiments, the high pressure turbine section includes an upstream rotor assembly; a downstream rotor assembly; a stator assembly disposed intermediate the downstream rotor assembly and the upstream rotor assembly; and a cover plate configured for attachment to a rear face of the downstream rotor assembly. In various embodiments, the cover plate includes an annular member having a radially inner portion and a radially outer portion with respect to a longitudinal axis, the radially inner portion including an aft face and an angled forward face, the angled forward face defining a forward face angle with respect to a cylindrical plane that is coaxial with the longitudinal axis, the face angle having a value that is greater than or equal to fifty degrees; a first tab and a second tab disposed proximate the radially inner portion of the annular member; and a slot disposed between the first tab and the second tab, the slot including a slot face that intersects the angled forward face along a forward intersection line, the forward intersection line including a sharp transition portion extending from a first slot end to a second slot end and the slot face intersecting the aft face along an aft intersection line, the aft intersection line including one of a chamfered portion or a radiused portion extending from the first slot end to the second slot end.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
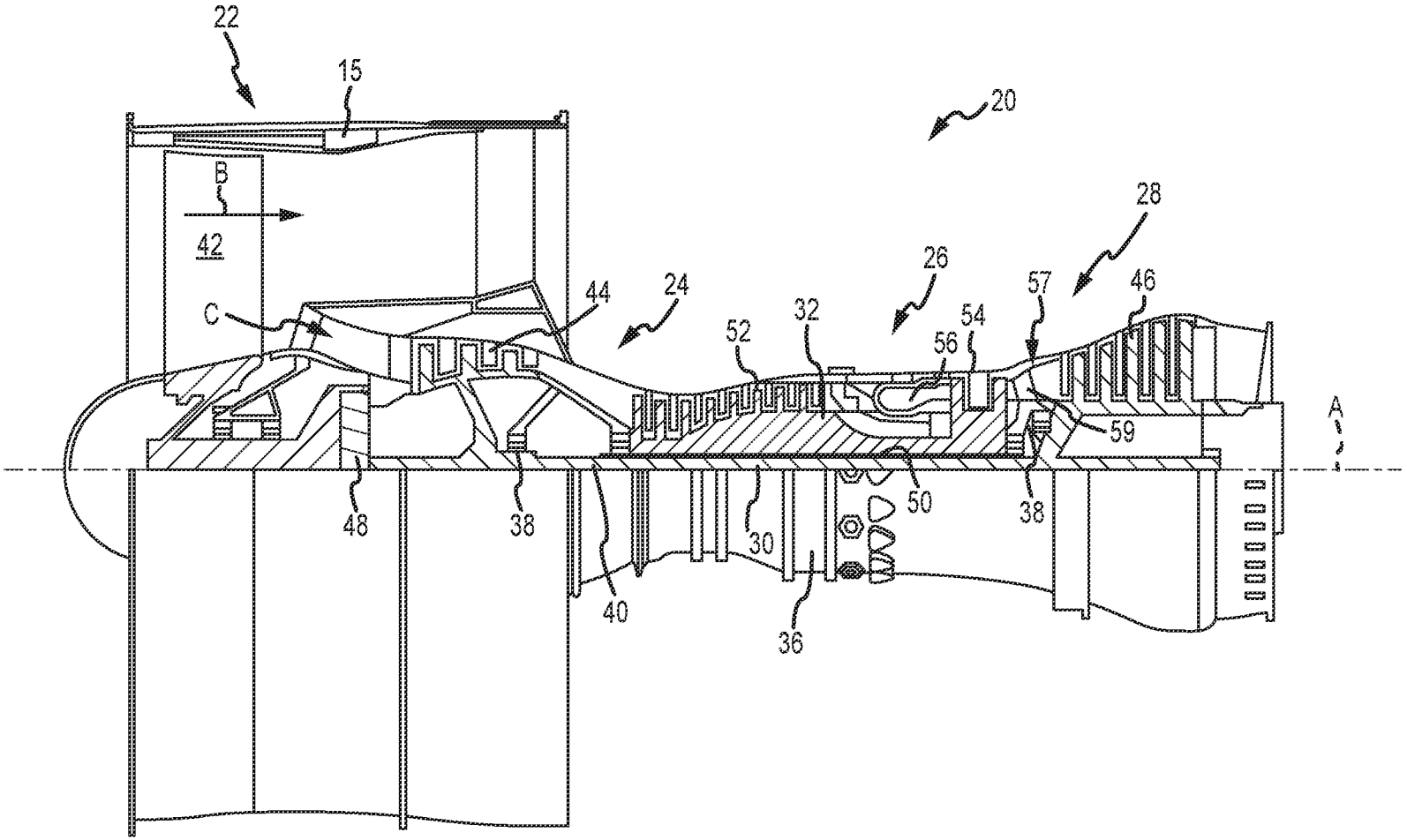
FIG. 1A is a schematic view of a gas turbine engine, in accordance with various embodiments.

Referring now to the drawings, FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a core or primary flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Figure 1B:
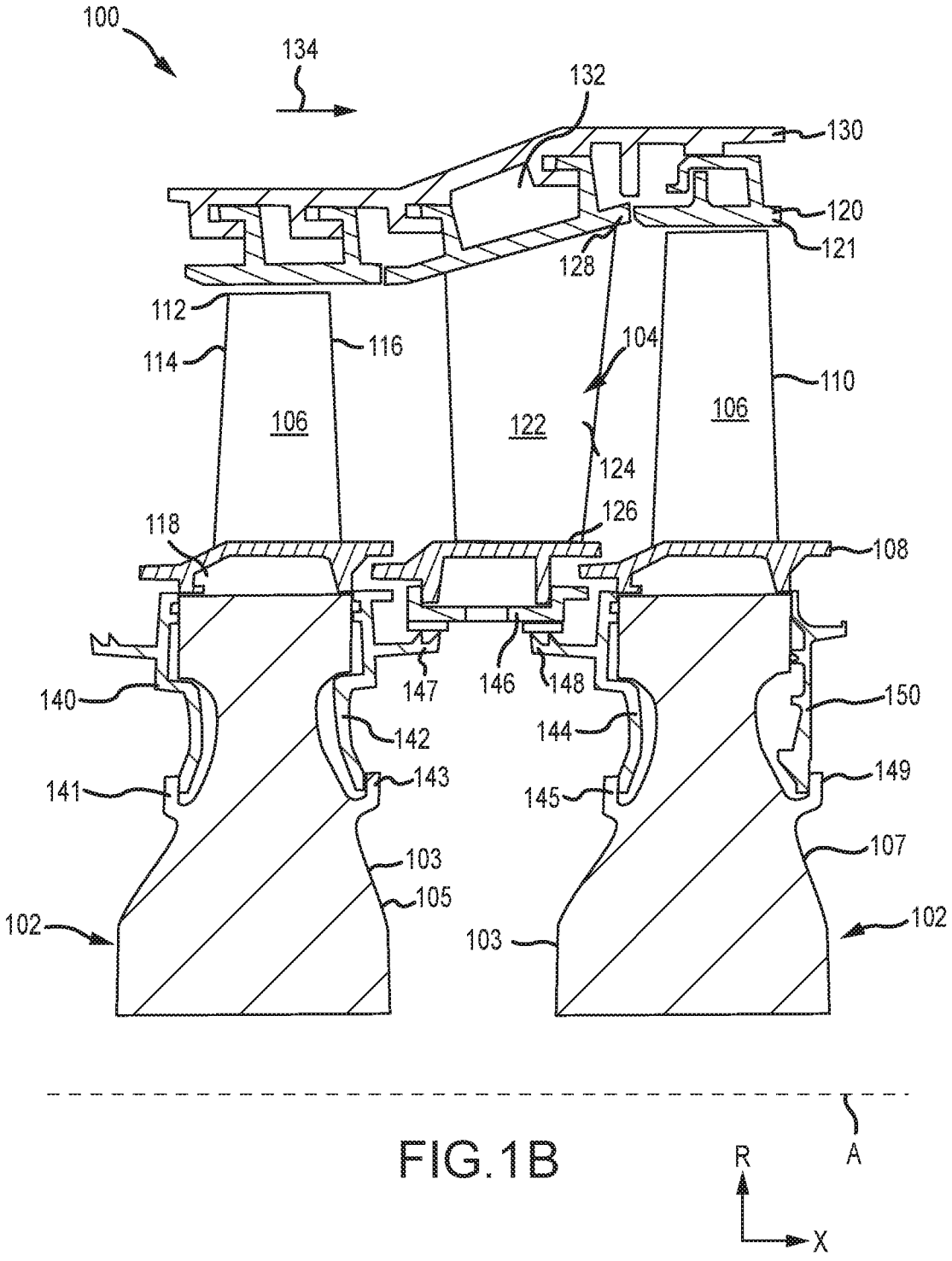
FIG. 1B is a schematic side view of a rotor and vane assembly of a turbine section of a gas turbine engine, in accordance with various embodiments.

Referring now to FIG. 1B, selected portions of a turbine section 100 of a gas turbine engine, such as, for example, the high pressure turbine 54 within the turbine section 28 described above with reference to FIG. 1A, are illustrated. The turbine section 100 includes alternating rows of rotor assemblies 102 and stator assemblies 104. Each of the rotor assemblies 102 carries one or more rotor blades 106 for rotation about a central longitudinal axis A. Each of the rotor blades 106 includes a rotor platform 108 and an airfoil 110 extending in a radial direction R from the rotor platform 108 to a rotor tip 112. The airfoil 110 generally extends in a chord-wise direction X between a leading edge 114 and a trailing edge 116. A root section 118 of each of the rotor blades 106 is mounted to a rotor disk 103, which may be either an upstream rotor disk 105 or a downstream rotor disk 107. A blade outer air seal (BOAS) 120 is disposed radially outward of the rotor tip 112 of the airfoil 110. The BOAS 120 includes a platform 121 that provides a seal to prevent hot gases from leaking outside the core airflow path C (see FIG. 1).

Each of the stator assemblies 104 includes one or more vanes 122 positioned along the central longitudinal axis A and adjacent to one or more rotor blades 106. Each of the vanes 122 includes an airfoil 124 extending between an inner vane platform 126 and an outer vane platform 128. The stator assemblies 104 are connected to an engine casing structure 130. The BOAS 120 and the stator assemblies 104 may be disposed radially inward of the engine casing structure 130. In various embodiments, one or both of the BOAS 120 and the stator assemblies 104 may include full annular platforms or they may be segmented and include feather seals between segments to help prevent leakage of cooling fluid between the segments. In various embodiments, one or more of the vanes 122 may be configured to rotate about an axis extending between the inner vane platform 126 and the outer vane platform 128.

Still referring to FIG. 1B, the turbine section 100 may also include a first front cover plate 140, a first rear cover plate 142, a second front cover plate 144 and a second rear cover plate 150. In various embodiments, the cover plates operate as air seals for air flow into and out of the rotor assemblies 102. In various embodiments, the cover plates may also serve to maintain the one or more rotor blades 106 within each rotor disk 103 corresponding to each of the rotor assemblies 102. In various embodiments, an annular seal 146 interfaces with a first knife edge seal 147 and a second knife edge seal 148. In various embodiments, the first knife edge seal 147 may be integral with the first rear cover plate 142 and the second knife edge seal 148 may be integral with the second front cover plate 144, respectively.

In various embodiments, the upstream rotor disk 105 includes a first front annular arm 141 and a first rear annular arm 143, both first annular arms extending generally in a radially outward direction from points of attachment to respective forward and aft faces of the upstream rotor disk 105 and configured to engage radially inner portions of the first front cover plate 140 and the first rear cover plate 142. Similarly, in various embodiments, the downstream rotor disk 107 includes a second front annular arm 145 and a second rear annular arm 149, both second annular arms extending generally in a radially outward direction from points of attachment to respective forward and aft faces of the downstream rotor disk 107 and configured to engage radially inner portions of the second front cover plate 144 and the second rear cover plate 150.

Figure 2A:
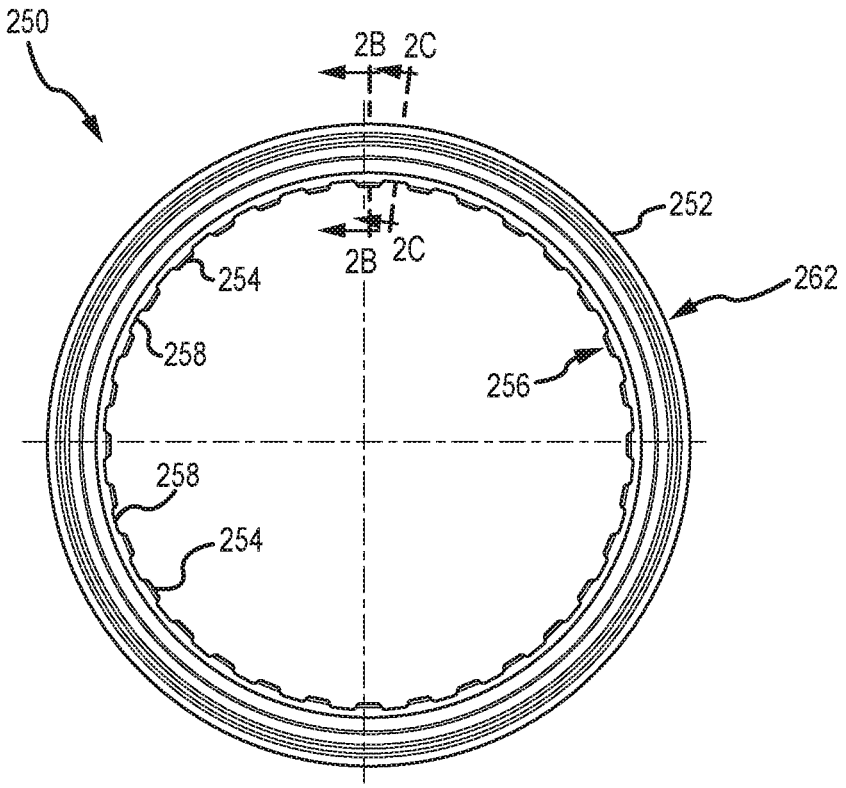
FIG. 2A is a schematic axial view of a cover plate used within a gas turbine engine, in accordance with various embodiments.
Figure 2B:
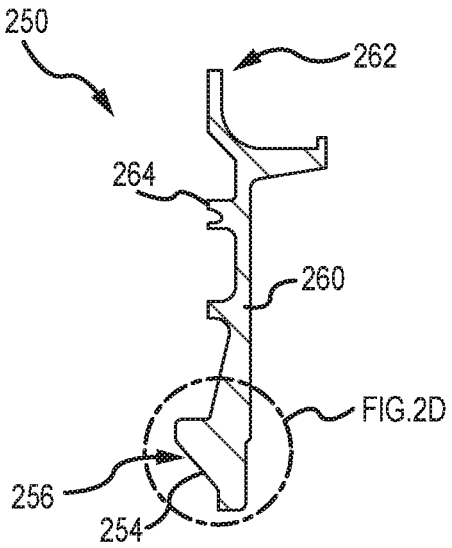
FIGS. 2B, 2C and 2D are schematic cross sectional views of the cover plate illustrated in FIG. 2A, in accordance with various embodiments.
Figure 2C:
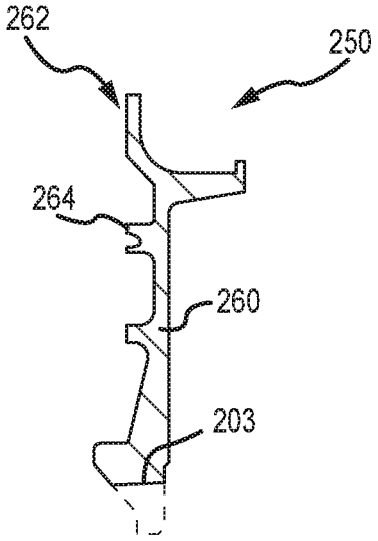
Figure 2D:
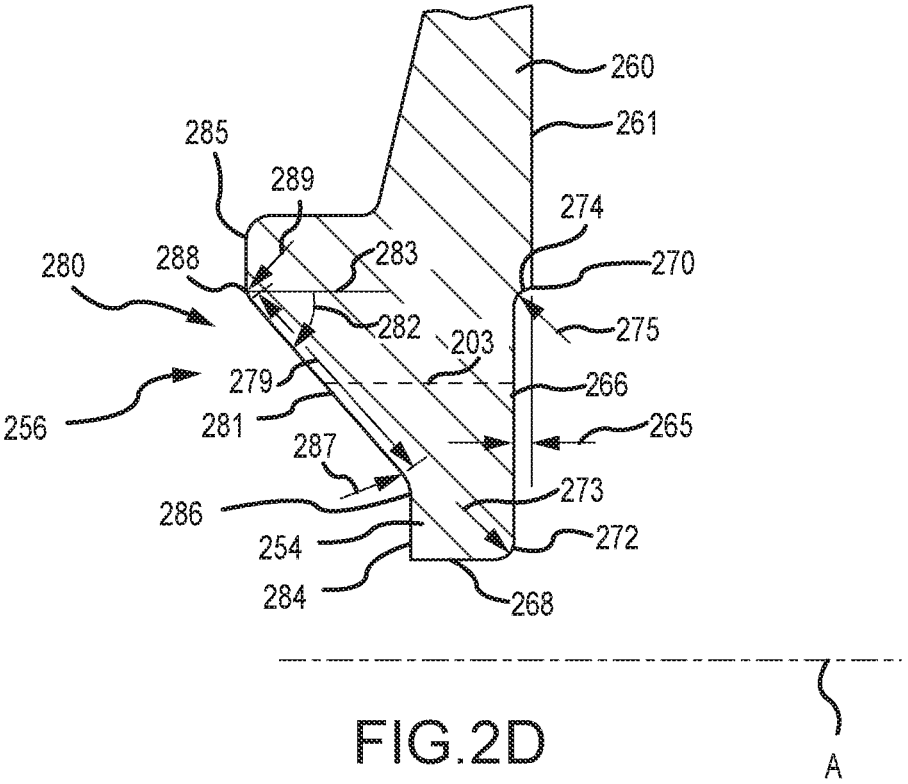

Referring now to FIGS. 2A, 2B, 2C and 2D, a cover plate 250, such as, for example, the second rear cover plate 150 described above with reference to FIG. 1B, is illustrated, in accordance with various embodiments. FIGS. 2B and 2C are cross sectional views of the cover plate 250, as indicated in FIG. 2A. FIG. 2D is an enlarged cross sectional view of a portion of the cover plate 250, as indicated in FIG. 2B. In various embodiments, the cover plate 250 (or cover seal) comprises an annular member 252 that extends annularly in circumferential fashion about a rotor disk, such as, for example, the downstream rotor disk 107 described above with reference to FIG. 1B. The cover plate 250 may also include, in various embodiments, a plurality of tabs 254 spaced circumferentially about a radially inner portion 256 of the cover plate 250. Each tab within the plurality of tabs 254 is spaced circumferentially from an adjacent tab to form a plurality of slots 258 that are also spaced circumferentially about the radially inner portion 256. In various embodiments, the cover plate 250 includes a web portion 260 extending radially between the radially inner portion 256 and a radially outer portion 262 of the cover plate 250. In various embodiments, the web portion 260 includes a web face 261 that extends substantially radially between the radially inner portion 256 and the radially outer portion 262, the web face 261 having a surface normal that is directed substantially parallel to a central longitudinal axis A. In various embodiments, a seal member 264, that extends substantially axially, is configured to maintain a seal against an adjacent face of a rotor disk, such as, for example, the downstream rotor disk 107 described above with reference to FIG. 1B.

Referring now to FIG. 2D, an enlarged cross sectional view of the radially inner portion 256 of the cover plate 250, including one of the plurality of tabs 254, is provided. In various embodiments, the radially inner portion 256 of the cover plate 250 includes an aft face 266. In various embodiments, the aft face 266 is configured for engagement with a corresponding face of an annular arm extending radially outward from a rotor disk, such as, for example, the second rear annular arm 149 of the downstream rotor disk 107, described above with reference to FIG. 1B. In various embodiments, the aft face 266 (together with the corresponding face of the annular arm) has a surface normal that is directed substantially parallel to the central longitudinal axis A. In various embodiments, the aft face 266 extends (in the vicinity of each of the plurality of tabs 254) from a radially inner tip portion 268 to a radially outer face portion 270. In various embodiments, the radially inner tip portion 268 transitions into the aft face 266 by a first radial portion 272 defining a first radius of curvature 273. Similarly, in various embodiments, the web face 261 transitions into the aft face 266 by a second radial portion 274, positioned proximate or overlapping the radially outer face portion 270, defining a second radius of curvature 275. In various embodiments, the aft face 266 is offset from the web face 261 by an offset distance 265, such that the aft face 266 extends in an axial direction into the radially inner portion 256 by the offset distance 265 with reference to the web face 261. In various embodiments, the aft face 266 has a surface normal (or aft face normal) directed substantially parallel to the longitudinal axis. In various embodiments, either or both of the first radius of curvature 273 and the second radius of curvature 275 may be large (e.g., infinite), resulting in a substantially flat, chamfered-type geometry at either or both of the first and second radial portions.

Referring still to FIG. 2D, the radially inner portion 256 includes an annular ring portion 280 that generally extends in an axial direction on a side of the cover plate 250 opposite the aft face 266. In various embodiments, the annular ring portion 280 includes an angled forward face 281 that is oriented at a forward face angle 282 with respect to a cylindrical plane 283 (e.g., a cylinder) that is parallel to (or coaxial with) the central longitudinal axis A. In various embodiments, the forward face angle 282 is within a range from about fifty degrees (50°) to about eighty degrees (80°); in various embodiments, the forward face angle 282 is within a range from about fifty degrees (50°) to about seventy degrees (70°); and in various embodiments, the forward face angle 282 is about sixty degrees (60°). In various embodiments, the angled forward face 281 extends from a first forward face 284 of the radially inner tip portion 268 to a second forward face 285. In various embodiments, the first forward face 284 transitions into the angled forward face 281 by a third radial portion 286 defining a third radius of curvature 287. In various embodiments, the first forward face has a surface normal (or first forward face normal) directed substantially parallel to the longitudinal axis. Similarly, in various embodiments, the second forward face 285 transitions into the angled forward face 281 by a fourth radial portion 288 defining a fourth radius of curvature 289. In various embodiments, the second forward face has a surface normal (or second forward face normal) directed substantially parallel to the longitudinal axis. In various embodiments, one or more of the first radius of curvature 273, the second radius of curvature 275, the third radius of curvature 287 and the fourth radius of curvature 289 are approximately equal to the offset distance 265. In various embodiments, each of the plurality of slots 258 defines a slot face 203 that intersects the angled forward face 281 about half way along a length 279 of the angled forward face 281.

Figure 3A:
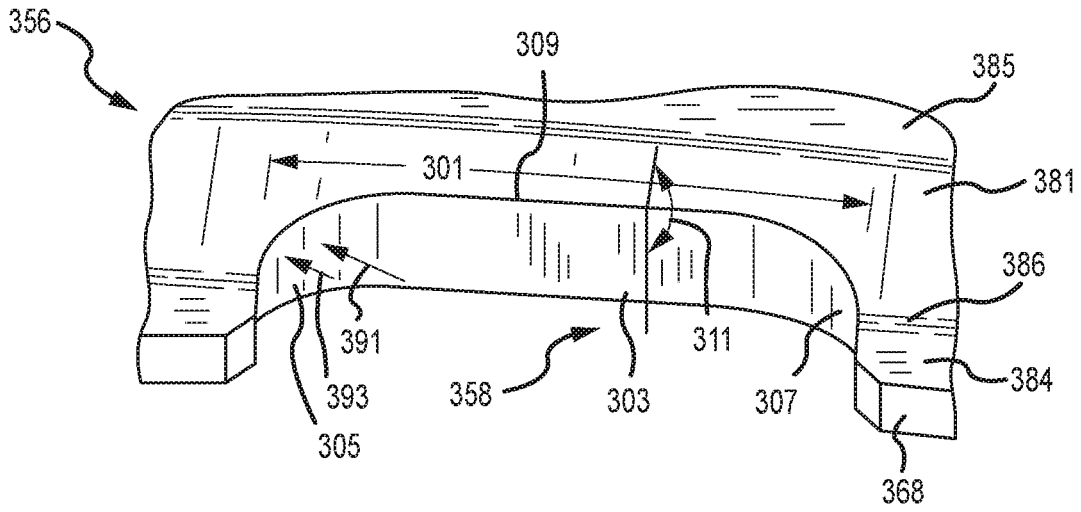
FIGS. 3A and 3B are schematic perspective views of a slot within a cover plate, in accordance with various embodiments.
Figure 3B:
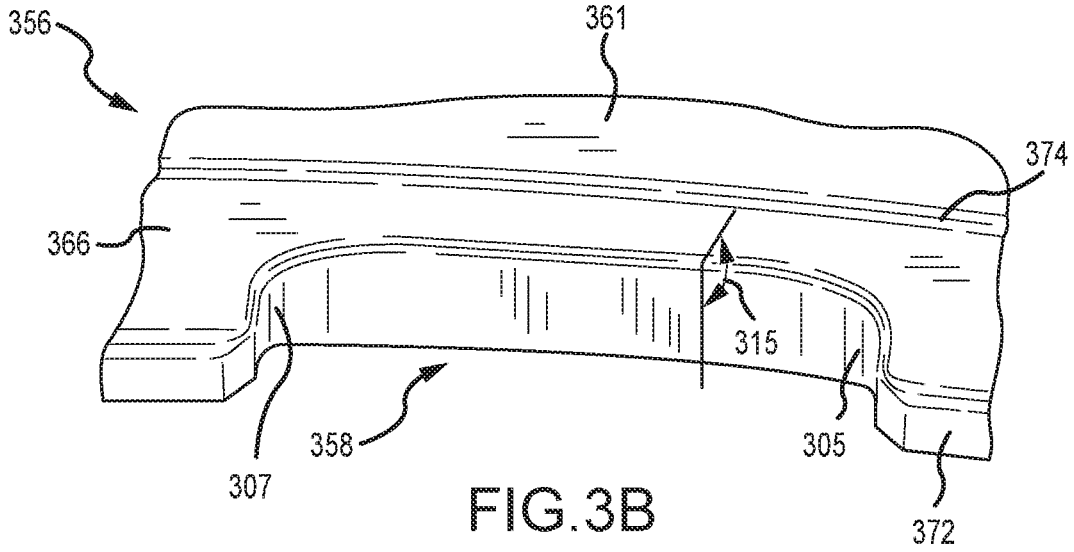

Referring now to FIGS. 3A and 3B, forward facing and aft facing views of a slot 358, such as, for example, one of the slots within the plurality of slots 258 described above with reference to FIG. 2A, are provided. Referring to FIG. 3A, the slot 358 includes a chordal length 301 that is, in various embodiments, about equal to or greater than a corresponding chordal length of each of the plurality of tabs, such as the plurality of tabs 254 described above with reference to FIG. 2A. The slot 358 is generally defined by a slot face 303 that extends along the chordal length 301 and transitions from a generally chordal and axially extending face to a generally radially and axially extending face at each of a first slot end 305 and a second slot end 307 of the chordal length 301. A fifth radius of curvature 391 generally defines the transition of the slot face 303 at the first slot end 305 and the second slot end 307. In various embodiments, a sixth radius of curvature 393, together with the fifth radius of curvature 391, define a compound radius for the transition from the chordal and axially extending face into the faces at the first slot end 305 and the second slot end 307, where, in various embodiments, the sixth radius of curvature is less than the fifth radius of curvature. In various embodiments, the slot face 303 intersects an angled forward face 381, such as, for example, the angled forward face 281 described above with reference to FIG. 2D, along a forward intersection line 309. In various embodiments, the forward intersection line 309 is defined by a forward intersection angle 311 where the angled forward face 381 and the slot face 303 intersect. In various embodiments, the forward intersection angle 311 is within a range from about one-hundred thirty degrees (130°) to about one-hundred degrees (100°); in various embodiments, the forward intersection angle 311 is within a range from about one hundred thirty degrees (130°) to about one-hundred ten degrees) (110°); and in various embodiments, the forward intersection angle 311 is about one hundred twenty (120°). In various embodiments, the forward intersection line 309 is defined by a sharp transition (e.g., an angled line defined by the intersection of two planes) between the angled forward face 381 and the slot face 303 with no or minimal chamfer or radius of curvature that would otherwise tend to smooth the forward intersection line 309. In various embodiments, on either side of the slot 358 is disposed a radially inner tip portion 368 having a first forward face 384, such as the radially inner tip portion 268 and the first forward face 284 described above with reference to FIG. 2D. In various embodiments, the first forward face 384 transitions into the angled forward face 381 by a third radial portion 386 defining a third radius of curvature 387, such as, for example, the third radial portion 286 described above with reference to FIG. 2D.

Referring now to FIG. 3B, in various embodiments, the slot face 303 intersects an aft face 366, such as, for example, the aft face 266 described above with reference to FIG. 2D, along an aft intersection line 313. In various embodiments, the aft intersection line 313 is defined by an aft intersection angle 315 where the aft face 366 and the slot face 303 intersect. In various embodiments, the aft intersection angle 315 is within a range from about eighty degrees (80°) to about one-hundred degrees (100°); in various embodiments, the aft intersection angle 315 is within a range from about eighty five degrees (85°) to about ninety five degrees (95°); and in various embodiments, the aft intersection angle 315 is about ninety degrees (90°). In various embodiments, the aft intersection line 313 is defined by a gradual transition between the aft face 366 and the slot face 303. In various embodiments, the gradual transition occurs with a chamfered or radiused portion that extends along and smooths the aft intersection line 313.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed:

1. A cover plate for a rotor assembly, comprising:

an annular member having a radially inner portion and a radially outer portion with respect to a longitudinal axis, the radially inner portion including an aft face and an angled forward face, the angled forward face defining a forward face angle with respect to a cylindrical plane that is coaxial with the longitudinal axis, the forward face angle having a value that is greater than or equal to fifty degrees;

a first tab and a second tab disposed proximate the radially inner portion of the annular member; and a slot disposed between the first tab and the second tab, wherein the cover plate further includes a web face extending radially from proximate the radially inner portion to proximate the radially outer portion, wherein the aft face is offset in a forward axial direction from the web face by an offset distance and wherein the slot includes a slot face that intersects the angled forward face along a forward intersection line.

2. The cover plate of claim 1, wherein the radially inner portion further includes a first forward face disposed radially inward of the angled forward face.

3. The cover plate of claim 2, wherein the radially inner portion further includes a second forward face disposed radially outward of the angled forward face.

4. The cover plate of claim 3, wherein the first forward face has a first forward face normal directed substantially parallel to the longitudinal axis.

5. The cover plate of claim 4, wherein the second forward face has a second forward face normal directed substantially parallel to the longitudinal axis.

6. The cover plate of claim 1, wherein the aft face is configured for engagement with an annular arm of a rotor disk.

7. The cover plate of claim 6, wherein the aft face includes an aft face normal that is directed substantially parallel to the longitudinal axis.

8. The cover plate of claim 1, wherein the forward intersection line includes a sharp transition portion extending from a first slot end to a second slot end.

9. The cover plate of claim 8, wherein the slot face intersects the aft face along an aft intersection line and wherein the aft intersection line includes a chamfered portion extending from the first slot end to the second slot end.

10. The cover plate of claim 8, wherein the slot face intersects the aft face along an aft intersection line and wherein the aft intersection line includes a radiused portion extending from the first slot end to the second slot end.

11. The cover plate of claim 1, wherein the forward face angle is within a range from about fifty degrees to about eighty degrees.

12. A rotor assembly for a turbine section of a gas turbine engine, comprising:

a rotor disk configured to rotate about a longitudinal axis;

a plurality of blades extending radially outward of the rotor disk from a rim portion of the rotor disk; and a cover plate configured for attachment to the rotor disk, comprising:

an annular member having a radially inner portion and a radially outer portion with respect to the longitudinal axis, the radially inner portion including an aft face and an angled forward face, the angled forward face defining a forward face angle with respect to a cylindrical plane that is coaxial with the longitudinal axis, the forward face angle having a value that is greater than or equal to fifty degrees;

a first tab and a second tab disposed proximate the radially inner portion of the annular member; and a slot disposed between the first tab and the second tab, wherein the cover plate further includes a web face extending radially from proximate the radially inner portion to proximate the radially outer portion, wherein the aft face is offset in a forward axial direction from the web face by an offset distance and wherein the slot includes a slot face that intersects the angled forward face along a forward intersection line.

13. The rotor assembly of claim 12, wherein the radially inner portion further includes a first forward face disposed radially inward of the angled forward face and a second forward face disposed radially outward of the angled forward face.

14. The rotor assembly of claim 13, wherein the first forward face has a first forward face normal directed substantially parallel to the longitudinal axis and the second forward face has a second forward face normal directed substantially parallel to the longitudinal axis.

15. The rotor assembly of claim 14, wherein the forward intersection line including a sharp transition portion extending from a first slot end to a second slot end and wherein the slot face intersects the aft face along an aft intersection line, the aft intersection line including one of a chamfered portion or a radiused portion extending from the first slot end to the second slot end.

16. The rotor assembly of claim 15, wherein the forward face angle is within a range from about fifty degrees to about eighty degrees.

17. A high pressure turbine section of a gas turbine engine, comprising:

an upstream rotor assembly;

a downstream rotor assembly;

a stator assembly disposed intermediate the downstream rotor assembly and the upstream rotor assembly; and a cover plate configured for attachment to a rear face of the downstream rotor assembly, comprising:

an annular member having a radially inner portion and a radially outer portion with respect to a longitudinal axis, the radially inner portion including an aft face and an angled forward face, the angled forward face defining a forward face angle with respect to a cylindrical plane that is coaxial with the longitudinal axis, the forward face angle having a value that is greater than or equal to fifty degrees;

a first tab and a second tab disposed proximate the radially inner portion of the annular member; and a slot disposed between the first tab and the second tab, the slot including a slot face that intersects the angled forward face along a forward intersection line, the forward intersection line including a sharp transition portion extending from a first slot end to a second slot end and wherein the slot face intersects the aft face along an aft intersection line, the aft intersection line including one of a chamfered portion or a radiused portion extending from the first slot end to the second slot end.

* * * * *